US006123601A

United States Patent [19]

Hildebrandt

[11] Patent Number: 6,123,601

[45] Date of Patent: Sep. 26, 2000

[54] BRA ARRANGEMENT

[76] Inventor: Cynthia K. Hildebrandt, P.O. Box 51, Bridgman, Mich. 49106

[21] Appl. No.: 09/407,931

[22] Filed: Sep. 28, 1999

[51] Int. Cl.[7] ..... A41C 3/00; A41F 1/00

[52] U.S. Cl. ..... 450/82; 24/306; 24/580

[58] Field of Search ..... 450/82, 80, 79, 450/77; 2/257, 323, 333, 338, 221, 237, 76, 141.2, 161.4, 912; 24/306, 580

[56] References Cited

U.S. PATENT DOCUMENTS

| | | | |
|---|---|---|---|
| 121,992 | 12/1871 | Clemens | 2/333 |
| 122,038 | 12/1871 | Lockwood | 2/333 |
| 1,154,584 | 9/1915 | Miller | 2/333 |
| 1,616,640 | 2/1927 | Sprague | 2/333 |
| 2,602,929 | 7/1952 | Chasinov | 2/42 |
| 2,653,323 | 9/1953 | Ganim | 2/42 |
| 2,668,954 | 2/1954 | Frohlich | 2/42 |
| 2,678,446 | 5/1954 | Fellner | 2/42 |
| 2,736,899 | 3/1956 | Ayres | 2/42 |
| 2,738,509 | 3/1956 | Bauder | 2/42 |
| 2,970,597 | 2/1961 | Michel | 128/482 |
| 3,191,603 | 6/1965 | Marino | 128/506 |
| 4,325,378 | 4/1982 | Wilkinson | 128/501 |
| 5,572,774 | 11/1996 | Duren | 24/306 |
| 5,727,337 | 3/1998 | Okajima | 36/50.1 |
| 5,894,640 | 4/1999 | Dewey | 24/306 |

*Primary Examiner*—John J. Calvert
*Assistant Examiner*—Alissa L. Hoey
*Attorney, Agent, or Firm*—Flynn, Thiel, Boutell & Tanis, P.C.

[57] ABSTRACT

A bra arrangement having a pair of straps which extend about the torso of the wearer and a closure element which allows a person with decreased hand dexterity to more easily take the bra on and off. The closure element includes a fastening member associated with a free end of one of the bra straps and a strap part associated with the free end of the other bra strap. The strap part defines a pair of opposed pressure sensitive fastening areas thereon which are releasably attachable to one another.

14 Claims, 5 Drawing Sheets

BRA ARRANGEMENT

FIELD OF THE INVENTION

This invention relates to a bra arrangement, and more particularly pertains to a bra arrangement including a closure element or adaptor which enables persons with decreased hand dexterity to easily take a bra on and off in a more independent manner.

BACKGROUND OF THE INVENTION

Undergarments such as bras typically include a pair of supportive cups and a pair of straps which extend around the upper torso to secure the bra to the wearer. The forward ends of the straps are fastened to a respective cup and the rearward or free ends thereof are often fastened together with a hook-and-eye type arrangement located adjacent the back of the wearer. This hook-and-eye arrangement includes one or more hooks which are secured to the free end of one of the straps and one or more corresponding eyelets which are secured to the free end of the opposite strap. The hooks of one strap are then engaged with the corresponding eyelets on the other strap to securely fasten the bra around the wearer. The hook-and-eye arrangements provided on conventional bras can be difficult to manipulate, not only due to the location thereof adjacent the back of the wearer, but also due to the very small size thereof. Thus, persons having decreased finger dexterity such as arthritis victims, and persons having limited or no usage of one hand such as stroke victims, often experience difficulty in manipulating the hook-and-eye arrangement and thus require assistance when dressing which can reduce a feeling of independence and have detrimental effects on the emotional well-being of the person.

It is therefore an object of the invention to provide a bra arrangement which overcomes the disadvantages of conventional bra arrangements as discussed above. Specifically, the bra arrangement according to the present invention includes a cup assembly and a pair of straps connected to and extending from opposite sides of the cup assembly and terminating in respective adjacent free ends. The pair of straps each include a fastening member mounted at the free end thereof. An adaptor is disposed between the free ends of the straps and includes a pair of fastening elements configured for cooperative engagement with the respective fastening members of the straps. Further, a strap part is located between the respective fastening elements and defines a pair of opposed fastening areas thereon which are attachable to one another to attach the straps together and are readily detachable from one another to detach the straps from one another.

The invention also relates to an adaptor for a bra having a cup arrangement and a pair of straps extending from opposite sides of the cup arrangement and terminating in adjacent free ends each including a fastening member thereon. The adaptor includes an elongate and flexible strap part which mounts thereon a first fastening element which cooperatively engages the fastening member of one of the bra straps, and a second fastening element which cooperatively engages the fastening member of the other bra strap. The strap part is slidably engaged with the second fastening element and has a pair of opposed portions respectively defining thereon fastening areas which are releasably attached to one another to interconnect the bra straps together.

The invention additionally relates to a bra including a cup assembly and a pair of straps connected to and extending outwardly from opposite sides of the cup assembly and terminating in adjacent free ends. A closure element is provided for interconnecting the free ends of the straps and includes a first fastening member connected to the free end of one of the straps and a second fastening member. The second fastening member includes a strap part having a first end portion connected to a free end of the other strap and a second end portion slidably associated with the first fastening member. Further, the strap part has first and second opposed portions respectively defining thereon cooperative pressure-sensitive fastening areas which are releasably attached to one another to interconnect the two straps to one another.

Other objects and purposes of the invention will be apparent to persons familiar with arrangements of this general type upon reading the following specification and inspecting the accompanying drawings.

Figure 1:
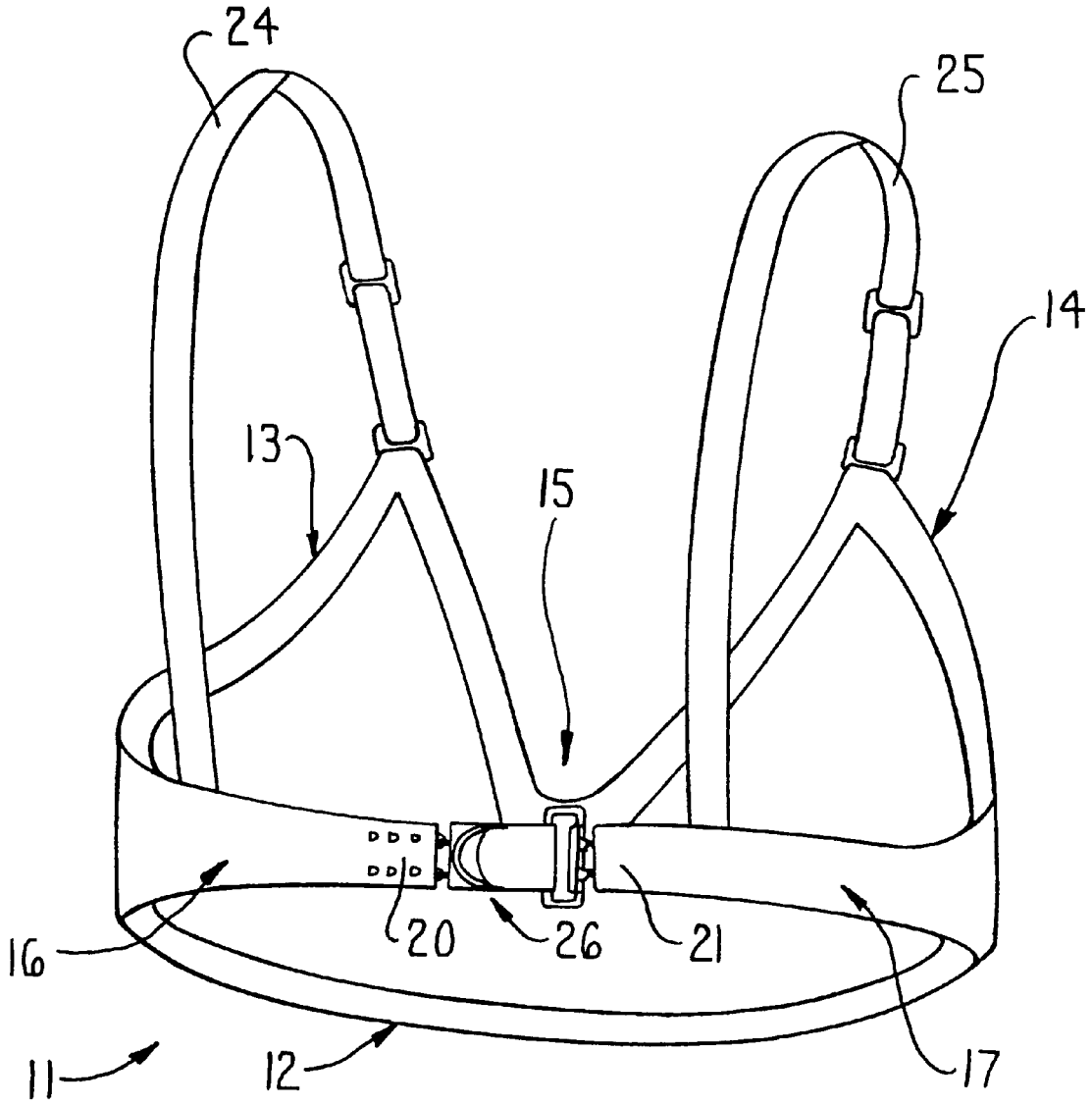
FIG. 1 is a perspective rear view of a bra arrangement according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
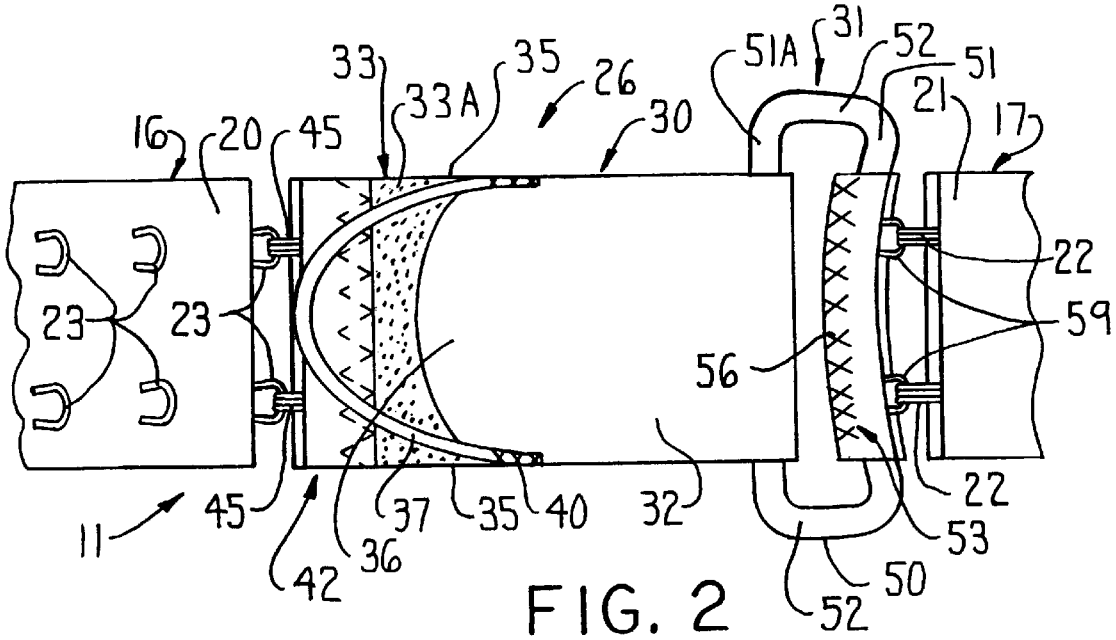
FIG. 2 is an enlarged, fragmentary detail view of FIG. 1 illustrating the adaptor assembled onto the free ends of a pair of bra straps, with the adaptor in a closed configuration.

Referring to the drawings, and specifically FIGS. 1 and 2, a bra arrangement 11 is illustrated according to the present invention. The bra arrangement 11 includes a bra 12 having one or more cups, and in the illustrated embodiment includes two cups 13 and 14 which are attached to one another at a generally centrally located hinge area 15. A first strap 16 and a second strap 17 are longitudinally aligned relative to one another and are attached at front ends thereof to the respective cups 13 and 14. The straps 16 and 17 are intended to extend rearwardly in opposite directions around the torso of the wearer and terminate in respective opposed and adjacent free ends 20 and 21.

A pair of generally J-shaped hooks 22 (FIGS. 2 and 3) are attached to free end 21 of strap 17 in a generally vertically aligned manner with one another, the hook parts of which hooks 22 project inwardly toward the back of the wearer. A pair of eyelets 23 are attached to free end 20 of strap 16 in a generally vertically aligned manner with one another, and are mounted to end 20 so as to project generally horizontally. In the illustrated embodiment, multiple pairs of eyelets 23 are attached to strap 16 and are horizontally spaced from one another along strap 16 to allow the wearer to adjust the fit or snugness of the bra 12 as desired. In this regard, additional pairs of eyelets 23 may be provided which are located further from the terminal end 20 of strap 16 than that shown in FIGS. 1 and 2.

The bra 12 may also be provided with shoulder straps 24 and 25 which are respectively connected to upper portions of cups 13 and 14, extend over the shoulder of the wearer and attach to the respective straps 16 and 17 to provide additional support to the wearer.

It will be appreciated that the above construction of bra 12 is conventional and additional details relating thereto will therefore not be discussed further herein.

With reference to FIGS. 1 and 2, an adaptor or closure element 26 is provided according to the invention which is interposed between the free ends 20 and 21 of bra 12 and is normally positioned at the back of the wearer. Adaptor 26 generally includes an elongate, flat and flexible strap part 30 and a rigid ring part 31.

Figure 4:
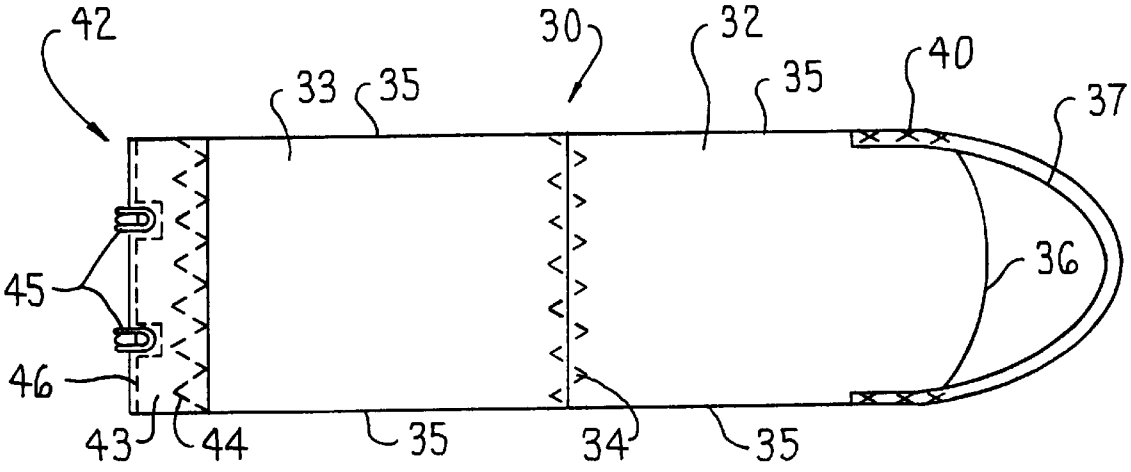
FIG. 4 is an enlarged view of one side of the strap part of the adaptor.
Figure 5:
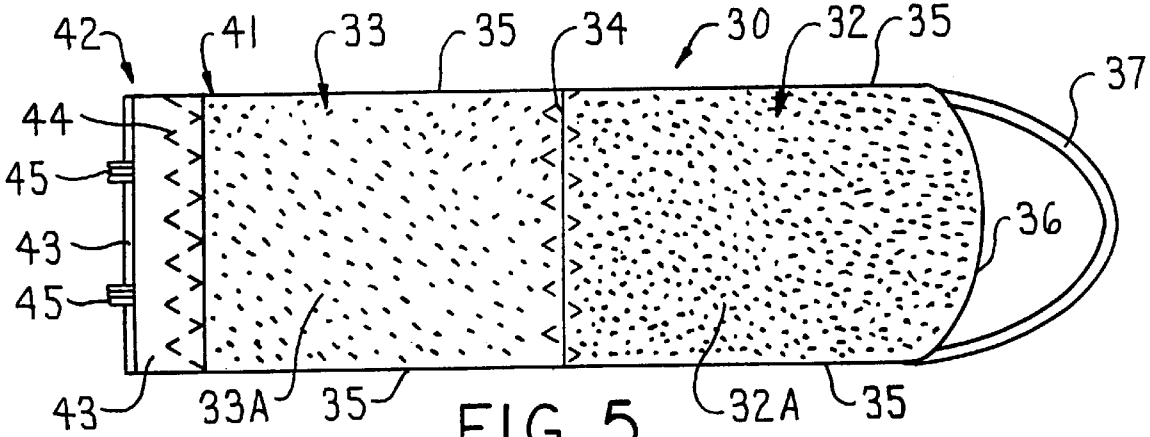
FIG. 5 is a view similar to FIG. 4, but illustrates the opposite side of the strap part.

As best shown in FIGS. 4 and 5, strap part 30 includes a hook and loop type fastening arrangement, such as is commonly sold under the trademark VELCRO®. More specifically, strap part 30 is embodied by a pair of first and second tape-like sections 32 and 33. The tape sections 32 and 33 have similar lengths and widths and are joined to one another along terminal transverse edges thereof at a seam 34 formed by stitching, for example, so that the longitudinal edges 35 of sections 32 and 33 are aligned with one another and form an elongate and continuous strip. The tape sections 32 and 33 in the illustrated embodiment are embodied by pieces of flexible woven material or fabric such as nylon, for example, which define fastening areas 32A and 33A thereon. One of these fabric pieces on one side thereof includes a plurality of hooks, and the other piece of fabric includes a plurality of loops with which the hooks are engagable as discussed below. Thus, one side of strap part 30 includes thereon a fastening area defined by a hook section and another fastening area defined by a loop section adjacent the hook section and divided therefrom by seam 34.

In the illustrated embodiment, an optional flexible and soft loop or handle 37 is attached to a rounded free end 36 of tape section 32 for a purpose as discussed below. Loop 37 may be constructed of a soft and flexible cord, and in the illustrated embodiment is fixed to tape section 32 via stitching 40 which secures the opposite ends of the loop 37 to the respective longitudinal sides 35 of section 32.

Figure 8:
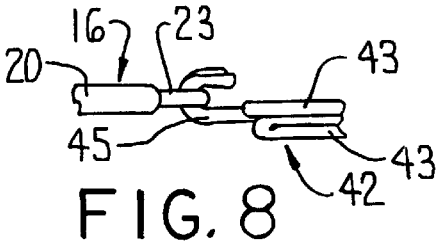
FIG. 8 is an enlarged, fragmentary top view as indicated by the arrow A in FIG. 3.

With continued reference to FIGS. 4 and 5, the free end 41 of tape section 33 has a fastener member 42 attached thereto which has a width similar to the width of tape sections 32 and 33 as defined between edges 35. Fastener member 42 is embodied by several fabric pieces or strips 43, such as twill, which pieces 43 wrap around or fold over the free end 41 of the tape section 33 and are attached thereto via a seam 44 formed by stitching, for example. A pair of generally J-shaped hooks 45 similar to hooks 22 of strap 17 are sandwiched between the fabric pieces 43 and are secured thereat by a seam 46 (see also FIG. 8). Seam 46 also serves to secure fabric pieces 43 to one another at ends thereof opposite seam 44. As shown in FIG. 2, the hooks 45 are attached to end 41 so that same project away from the hook-and-loop side of strap part 30. It will be appreciated that tape sections 32 and 33 may be attached to one another via other methods, and loop 37 and hooks 45 may be attached to the respective tape sections 32 and 33 via other methods, provided that these methods do not cause discomfort to the user.

The ring part 31 of adaptor 26 is embodied by a generally D-shaped ring 50 which in the illustrated embodiment includes a pair generally vertical and elongate legs 51 and 51A which are horizontally spaced-apart from one another and are interconnected by a pair of shorter legs 52 which extend transversely between the respective legs 51 and 51A to provide ring part 31 with a generally rectangular shape with rounded corners. For the comfort of the user, ring part 31 may be constructed of smooth and lightweight plastic, such as nylon, and may also have a generally circular or otherwise rounded cross-sectional configuration free of sharp corners or jagged edges.

Figure 7:
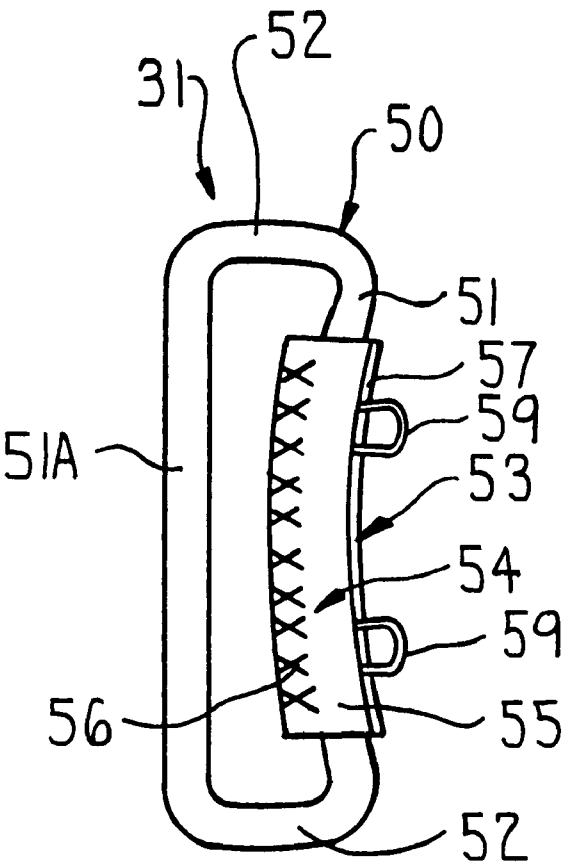
FIG. 7 is a view similar to FIG. 6, but illustrates the opposite side of the ring part.
Figure 6:
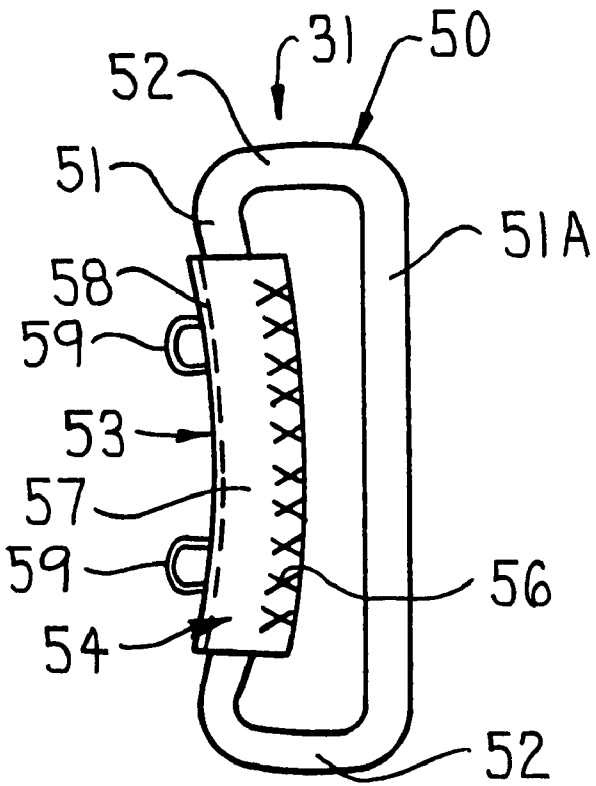
FIG. 6 is an enlarged view of one side of the ring part of the adaptor.

As shown in FIGS. 6 and 7, part 31 is provided with a fastener member 53 which is embodied by an elongate and generally cylindrical tube 54 of fabric, such as twill, which substantially snugly surrounds leg 51. In the illustrated embodiment, tube 54 is constructed of a piece of fabric 55 which is wrapped around or folded over leg 51 and the terminal edges of fabric piece 55 are then attached to one another by a seam 56 formed by stitching, for example. An additional piece of fabric 57 is then attached to and superimposed over one folded side of fabric piece 55 via seam 56 and a seam 58, and a pair of eyelets 59 are sandwiched between the fabric pieces 55 and 57 and secured thereat via seam 58 which secures eyelets 59 to tube 54.

Figure 3:
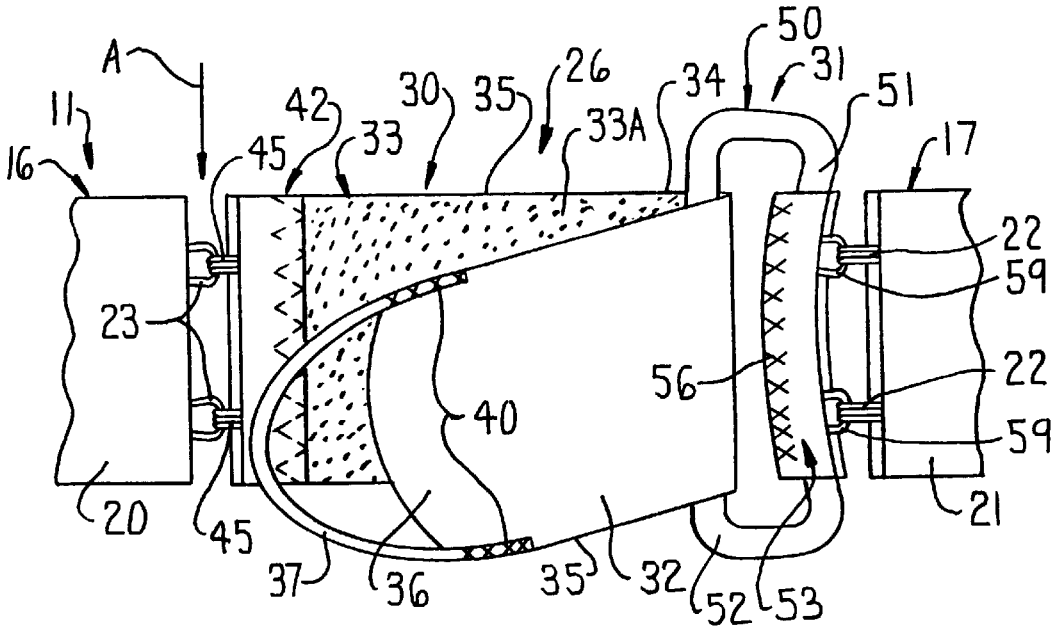
FIG. 3 is a view similar to FIG. 2, but illustrates the adaptor in a partially open configuration.

In use, with reference to FIGS. 1–3, the adaptor 26 is attached to bra 12 between free ends 20 and 21 of the respective straps 16 and 17. More specifically, the strap part 30 of adaptor 26 is assembled onto bra strap 16 by inserting hooks 45 of strap part 30 into the respective eyelets 23 of bra strap 16 so that the fastener areas 32A and 33A strap part 30 face outwardly and away from the body of the wearer. The ring part 31 is then assembled to bra strap 17 by inserting hooks 22 of bra strap 17 into the respective eyelets 59 of fastener member 53. The free end 36 and loop 37 of strap part 30 are then inserted through the ring 50 (i.e. between legs 51 and 51A) and around leg 51A, and tape section 32 is then folded over along an imaginary line generally parallel to seam 34. Fastener area 32A of section 32 is pressed onto fastening area 33A of tape section 33 to engage the opposed hook and loop sections with one another. When removal of the bra 12 is desired, the wearer simply grips loop 37 with a finger or fingers and pulls to disengage tape section 32 from tape section 33 and allow tape section 32 to pass through ring 50 to detach bra straps 16 and 17 from one another. The adaptor 26, once assembled onto a bra 12, can remain assembled or connected thereto until removal is necessary or desirable. Thus, once the adaptor 26 is installed on a bra, the wearer can put on and take off the bra without the need to manipulate the tiny hooks and eyes.

The length of the adaptor 26 can be adjusted by adjusting the overlap of tape sections 32 and 33 accordingly, provided that enough surface area of fastener areas 32A and 33A remain in contact with one another to ensure a secure fastening. Further, it will be appreciated that the adaptor 26, if desirable, can be utilized to add several inches to the overall length of bra 12 as same extends around the torso by installing the fastener member 42 onto the pair of eyelets 23 located closest to the terminal end of strap 16 (i.e. as shown in FIGS. 2 and 3). Otherwise, the fastener member 42 can be installed on other pairs of eyelets 23 located further away from the terminal end of strap 16 (FIG. 2) as appropriate.

For the comfort of the user, it may be desirable to cover at least the rear side of tape section 33 which would normally contact the wearer's skin (i.e. opposite fastener area 33A) with a soft material such as twill or flannel, for example.

It will be appreciated that tube 54 may instead be formed of a single layer of fabric which is wrapped around leg 51, and the opposite terminal edges of which can then be sewn together with eyelets 59 sandwiched therebetween. It will also be appreciated that strap part 30 may alternatively be constructed from a single elongate piece of soft and flexible woven material, and that a separate hook patch and a separate loop patch may then be attached to this woven material in locations corresponding to tape sections 32 and 33.

It will be understood that the loop or handle 37 is optional since the wearer can instead grasp the free end 36 of strap part 30 and pull to open the adaptor 26. For example, stroke victims often have usage of one hand and thus may be capable of such a grasping motion. However, loop 37 is particularly useful for persons having limited finger dexterity as is often the case with arthritis victims. As an alternative to loop 37, tape section 32 may be provided with a flap or tab at terminal end 36 thereof to provide a gripping handle for the wearer to utilize when putting on or removing the bra.

The adaptor 26 according to the invention may be utilized with most bras of a conventional configuration, and is illustrated herein in use with a bra 12 having a pair of hooks 22 fixed to the right strap 17 (with reference to FIG. 1) and a pair of eyelets 23 fixed to the left strap 16. However, the adaptor 26 may also be used with a bra having a reverse configuration, that is, wherein hooks are provided on the left strap 16 and the eyelets are provided on the right strap 17 simply by inverting the adaptor from the position shown in FIGS. 2 and 3 (i.e. by rotating the adaptor 180° in a plane parallel to the drawing plane so that the loop 37 would be located to the right and the ring 50 on the left). In addition, the vertical spacing between the respective hooks 45 and eyelets 59 of adaptor 26 should be approximately equal to the spacing between the corresponding eyelets 23 and hooks 22 of straps 16 and 17. In this regard, since the vertical spacing of the respective hooks and eyelets on many conventional bras is uniform, the adaptor 26 can be retrofitted on to most conventional rear-closing bras.

It will be understood that the overall length of strap part 30 and thus adapter 26 may be varied, as well as the width thereof as defined between longitudinal edges 35. As an example, however, the length of strap part 30 as measured between end 36 and fastener member 42 may be approximately 4 to 4 and ½ inches, and the width as measured between longitudinal edges 35 may be approximately 1 and ½ inches. The length of each tape section 32 and 33 may be approximately 2 inches, and loop 37 may be approximately 3 and ⅓ inches in length and approximately ⅛ inch in thickness.

Figure 10:
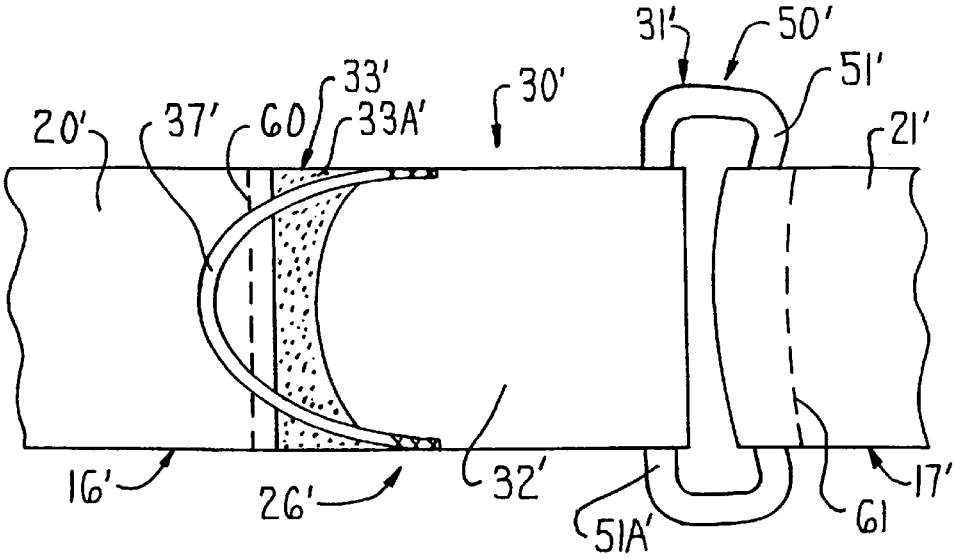
FIG. 10 is an enlarged, fragmentary detail view of FIG. 9.
Figure 9:
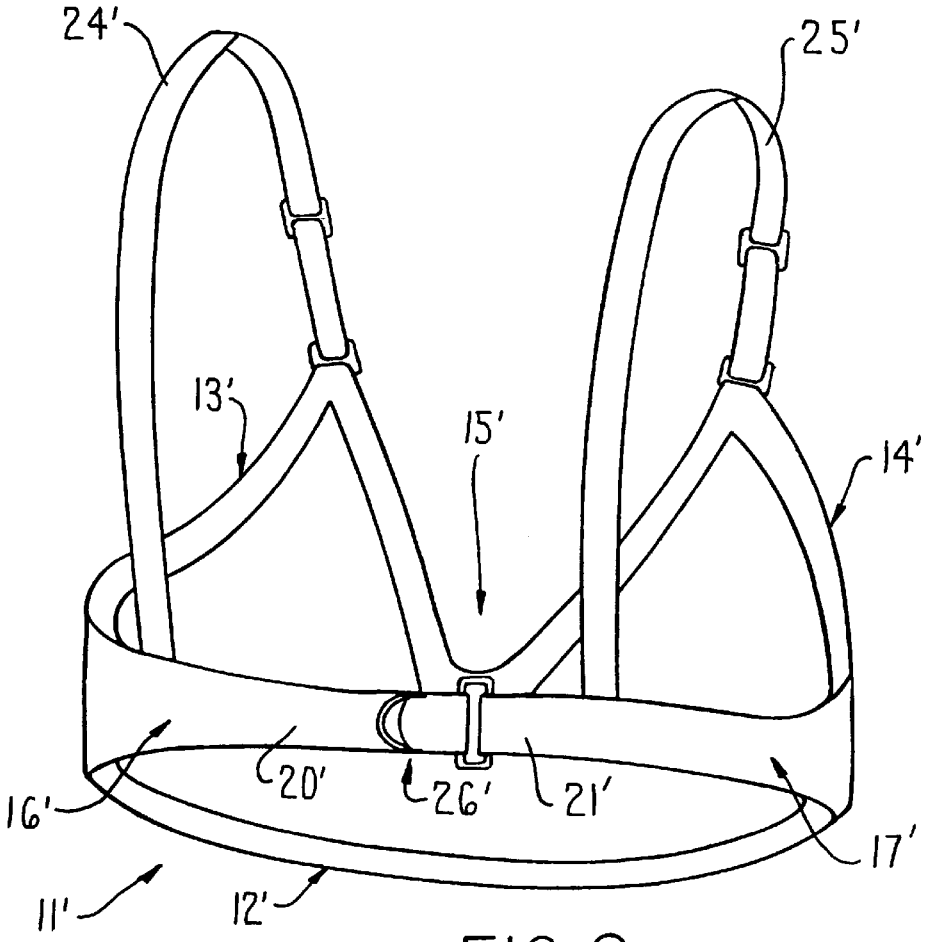
FIG. 9 is a perspective rear view of an additional embodiment of the bra arrangement.

An additional embodiment of the invention is illustrated in FIGS. 9 and 10, which embodiment is similar to the embodiment of FIGS. 1–8. Therefore, the same or similar components are depicted with the same reference numerals, plus a prime. Reference numbers 13' and 14' represent cups similar to cups 13 and 14; reference number 15' represents a hinge area similar to hinge area 15;

and reference numbers 24' and 25' represent straps similar to shoulder straps 24 and 25. The embodiment of FIGS. 9 and 10 is essentially identical to the previous embodiment, except that the closure element 26' does not include the fastener members 42 and 53. Instead, the closure element 26' forms the sole rear closure of the bra 12'. More specifically, the free end 20' of bra strap 16' is directly attached to the end of strap part 30' adjacent fastener area 33A', for example via a seam 60. Further, the ring part 50' is attached directly to the free end 21' of strap 17', for example by inserting end 21' through ring part 50' and then folding end 21' over upon itself to form a loop which encloses the leg 51' of ring part 50'. The free end 21' can then be fixed in this loop configuration via a seam 61. It will be appreciated that other methods of attaching closure element 26' to straps 16' and 17' may be utilized. Thus, the closure element 26' of FIGS. 9 and 10 is an integral component of the bra 12'.

In use, the wearer simply inserts the free end 36' through ring part 50' and folds tape section 32' over so that the fastener area thereof (not shown in FIGS. 9 and 16) opposes fastener area 33A'. The wearer then presses the tape sections 32' and 33' together to attach the respective fastener areas together. Opening of closure element 26' is achieved by pulling loop 37' (if provided) or alternatively the free end 36' of strap part 30' to detach the fastening areas from one another.

The embodiment of FIGS. 9 and 10 thus imparts an even greater feeling of independence to the wearer, since there is no need to manipulate any hook-and-eye type arrangement.

The closure element 26' can be utilized to adjust the fit or tightness of straps 16' and 17' around the torso by adjusting the overlap of the fastener areas, provided that enough surface area of the fastener areas remain in contact with one another to prevent disengagement. In addition, the bra 12' depicted in FIGS. 9 and 10 can be conventionally sized, taking into account the amount of adjustment which closure element 26' is capable of providing, so that the purchaser can choose the appropriate size.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A bra arrangement comprising:

a cup assembly;

first and second straps connected to and extending generally horizontally from opposite sides of said cup assembly and around a human torso and terminating in respective adjacent free ends, said first and second straps respectively including first and second fastening members mounted at the respective said free ends thereof; and an adaptor disposed between and interconnecting said free ends of said first and second straps, said adaptor having first and second fastening elements configured for cooperatively engaging the respective said first and second fastening members and a ring part mounting said first fastening element thereon, said adaptor further including a strap part disposed between said first and second fastening elements and defining a pair of opposed pressure sensitive fastening areas thereon which are attachable to one another, said strap part being foldable and flexible to position said fastening areas in juxtaposed and face-to-face relation with one another to attach said first and second straps to one another, said fastening areas being readily detachable from one another to detach said first and second straps from one another, and said strap part mounting said second fastening element at one end thereof and including a handle member at an opposite end thereof for grasping to assist in detaching said fastening areas from one another.

2. The arrangement of claim 1 wherein one of said first fastening element and said first fastening member includes an eyelet and the other said first fastening element and first fastening member includes a hook.

3. The arrangement of claim 2 wherein one of said second fastening element and said second fastening member includes an eyelet and the other said second fastening element and second fastening member includes a hook.

4. The arrangement of claim 1 wherein said handle member comprises a loop having terminal ends fixed to said strap part.

5. The arrangement of claim 1 wherein said fastening areas together define a cooperative hook and loop-type fastening arrangement.

6. The arrangement of claim 1 wherein said ring part is defined by a pair of generally vertically oriented legs and a pair of generally horizontally oriented legs extending transversely between said vertical legs, said first fastening element being mounted on one said vertical leg adjacent said first fastening member, said strap part extending through said ring part and being foldable about and engaging with the other said vertical leg to position said fastening areas in face-to-face relation with one another.

7. An adaptor for a bra having a cup arrangement and a pair of straps extending outwardly from opposite sides of said cup arrangement and terminating in adjacent free ends each including a fastening member thereon, said adaptor comprising:

an elongate and flexible strap part mounting thereon a first fastening element configured for cooperative engagement with the fastening member of one of the bra straps; and a second fastening element configured for cooperative engagement with the fastening member of the other bra strap, said strap part being slidably engaged with said second fastening element and having first and second opposed portions respectively defining thereon fastening areas which are releasably attached to one another to interconnect the bra straps to one another, said second fastening element including a generally ring-shaped member, said first portion of said strap part mounting thereon said first fastening element at one end thereof and at an opposite end being connected to one end of said second portion, said second portion extending through said ring-shaped member and being foldable onto said first portion to orient said fastening areas in juxtaposed face-to-face relation with one another, and a free end of said second portion mounts a handle member thereon configured for grasping to assist in detaching said fastening areas from one another.

8. The adaptor of claim 7 wherein said second fastening element includes a tubular part which surrounds a first leg of said ring-shaped member adjacent the fastening member of the other bra strap, said tubular part mounting thereon an eyelet configured for engagement with a hook of the fastening member of the other bra strap, said strap part extending around and engaging a second leg of said ring-shaped member opposite and spaced from said first leg, and said first fastening element mounts thereon a hook configured for engagement with an eyelet of the fastening member of the one bra strap.

9. The adaptor of claim 7 wherein said fastening areas together define a cooperative hook-and-loop type fastening arrangement.

10. A bra comprising:

a cup assembly;

first and second straps connected to and extending outwardly from opposite sides of said cup assembly and terminating in adjacent free ends; and a closure element for interconnecting said free ends of said first and second straps, said closure element including a first fastening member connected to said free end of said first strap and a second fastening member, said second fastening member including a strap part having a first end portion connected to said free end of said second strap and a second end portion slidably associated with said first fastening member, said strap part comprising a continuous elongate and flexible strip of material having first and second sides which face away from one another and first and second opposed portions defined on said first side which respectively define thereon cooperative pressure-sensitive fastening areas releasably attached to one another to interconnect said first and second straps to one another, said second end portion of said strap part being insertable through an opening in said first fastening member and foldable over and onto said first end portion to position said fastening areas in juxtaposed face-to-face relation with one another, and said second end portion of said strap part mounting thereon a graspable handle member to assist in detaching said fastening areas from one another.

11. The adaptor of claim 10 wherein a first part of said second side is disposed to lie against the back of the bra wearer and a second part of said second side faces outwardly and away from the back of the wearer upon folding of said strap part.

12. The adaptor of claim 10 wherein said fastening areas together define a cooperative hook-and-loop type fastening arrangement.

13. The adaptor of claim 10 wherein said strap member is adjustable in length to permit adjustment of the distance between the free ends of the first and second bra straps.

14. The bra of claim 10 wherein said first fastening member includes a ring-shaped part and said second end portion of said strap part is insertable through said ring-shaped part and is foldable around and engageable with a portion of said ring-shaped part to position said fastening areas in face-to-face relation with one another.

* * * * *